US012673796B2

(12) United States Patent
Serizawa et al.

(10) Patent No.: US 12,673,796 B2
(45) Date of Patent: Jul. 7, 2026

(54) UNFOLDING DEVICE AND UNFOLDING METHOD

(71) Applicant: TOYOTA JIDOSHA KABUSHIKI KAISHA, Toyota (JP)

(72) Inventors: Kazumi Serizawa, Toyota (JP); Naoyuki Taguri, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 120 days.

(21) Appl. No.: 18/915,363

(22) Filed: Oct. 15, 2024

(65) Prior Publication Data

US 2025/0236429 A1 Jul. 24, 2025

(30) Foreign Application Priority Data

Jan. 24, 2024 (JP) ..... 2024-008549

(51) Int. Cl.
*B65B 69/00* (2006.01)

(52) U.S. Cl.
CPC ..... *B65B 69/0033* (2013.01); *B65B 2220/04* (2013.01)

(58) Field of Classification Search
CPC ..... B65B 69/00; B65B 69/0033; B65B 43/26; B65B 43/00; B65B 220/04; B26D 7/00; B26D 7/01; B26D 7/02; B26D 7/025
See application file for complete search history.

(56) References Cited

U.S. PATENT DOCUMENTS 2,729,885 A * 1/1956 Wahl ..... B65B 69/0033 414/412
3,137,068 A * 6/1964 Quigley ..... B65B 69/0033 30/2
6,694,852 B1 * 2/2004 Ours ..... B65B 69/0033 414/412
2019/0184671 A1 * 6/2019 Yokota ..... B65B 43/26
2022/0219857 A1 * 7/2022 Tsujimori ..... B25J 15/009

FOREIGN PATENT DOCUMENTS

JP 2020-075731 A 5/2020

* cited by examiner

*Primary Examiner* — Phong H Nguyen
(74) *Attorney, Agent, or Firm* — SoraIP, Inc.

(57) ABSTRACT

An unfolding device according to the present disclosure includes a frame, stress concentrating members, a plurality of movable portions, and a power transmission portion. The stress concentrating member located in the space is brought into contact with the inside of an empty box from the opening side of the empty box, whereby the empty box is placed, and the power transmission portion transmits power for moving the stress concentrating member to the stress concentrating member so as to bring the stress concentrating member into contact with the corner, and transmits power for moving the stress concentrating member to the stress concentrating member so as to cause the stress concentrating member to unfold the corner by tearing and unfolding the corner, and the stress concentrating member includes a reverse slope blade that protrudes outward as the blade gets closer to a top of the blade.

5 Claims, 6 Drawing Sheets

UNFOLDING DEVICE AND UNFOLDING METHOD

CROSS-REFERENCE TO RELATED APPLICATION

This application claims priority to Japanese Patent Application No. 2024-008549 filed on Jan. 24, 2024, incorporated herein by reference in its entirety.

BACKGROUND

1. Technical Field

The present disclosure relates to unfolding devices and unfolding methods.

2. Description of Related Art

For example, when a worker performs the work of unfolding cuboid boxes into single cross-shaped flat sheets and stacking them on top of each other, he/she cuts along the edges of each three-dimensional box with a hand tool such as scissors or a cutter and stacks the unfolded boxes on top of each other, which is burdensome. When such work is performed by an automated machine, boxes are typically placed into a large crusher designed to crush boxes as they are.

Japanese Unexamined Patent Application Publication No. 2020-075731 (JP 2020-075731 A) describes a cardboard box unpacking system for automatically opening a cardboard box and placing an item contained in the cardboard box onto a tray. The cardboard box unpacking system of JP 2020-075731 A cannot unfold a cardboard box into a single cross-shaped flat sheet in one operation.

SUMMARY

In mass production lines, general-purpose returnable boxes are used for logistics so as not to produce cardboard waste etc. However, batteries arrive at factories in cardboard boxes for various reasons such as the size of the batteries as a product and marine transportation rules. Packaging members including cardboard boxes are typically "soft materials with no guaranteed precision," and as described above, there are cases where unpacking and waste disposal are assumed to be done by humans. Therefore, the work of unfolding cardboard boxes into single cross-shaped flat sheets is the work that falls between logistics and a mass production line, and improvement in productivity of such work by automated machines (robots) has not even been considered. Accordingly, it has been taking a long time to unfold empty boxes into single cross-shaped flat sheets.

The present disclosure was made to solve such an issue, and an object of the present disclosure is to provide an unfolding device and unfolding method that can unfold an empty box into a single cross-shaped flat sheet in a short time.

An unfolding device according to one aspect of the present disclosure is an unfolding device configured to unfold an empty box into a single cross-shaped flat sheet. The unfolding device includes:

- a placement frame that provides a placement space for placing the empty box that is open before unfolding;
- a plurality of stress concentrating members configured to unfold a plurality of corners where inner side surfaces of the empty box meet;

- a plurality of movable portions attached to the stress concentrating members; and
- a power transmission portion configured to transmit power for moving a stress concentrating member via a movable portion.

The stress concentrating member is configured to be located in the placement space and contact an inside of the empty box from an open side of the empty box when the empty box is placed. The power transmission portion is configured to transmit the power for moving the stress concentrating member to the stress concentrating member so as to bring the stress concentrating member into contact with a corner. The power transmission portion is configured to further transmit the power for moving the stress concentrating member to the stress concentrating member so as to cause the stress concentrating member to unfold the corner by tearing and opening the corner.

The stress concentrating member includes a reverse slope blade that protrudes outward as the blade gets closer to a top of the blade.

In the above unfolding device,

- the stress concentrating member may include a safety cover that stores the blade, and the safety cover may be configured to
- allow the empty box to be placed on a top part of the safety cover, and
- move the empty box floating with respect to the placement frame while centering the empty box in the placement space.

In the above unfolding device,

- the safety cover may be attached to the movable portion via a spring,
- the blade may be attached to the movable portion, and
- the power transmission portion may be configured to
- transmit the power for moving the safety cover to the safety cover via the spring and the movable portion, and
- transmit the power for moving the blade to the blade via the movable portion.

In the above unfolding device,

- the power transmission portion may be configured to transmit the power for moving the safety cover storing the blade to the safety cover so as to bring the safety cover into contact with the corner, and the power transmission portion may be configured to further transmit the power for moving the blade to the blade so as to expose the blade from the safety cover that is in contact with the corner and to cause the blade to unfold the corner by tearing and opening the corner.

An unfolding method according to another aspect of the present disclosure is an unfolding method for unfolding an empty box into a single cross-shaped flat sheet using an unfolding device.

The unfolding device includes

- a placement frame that provides a placement space for placing the empty box that is open before unfolding,
- a plurality of stress concentrating members configured to unfold a plurality of corners where inner side surfaces of the empty box meet,
- a plurality of movable portions attached to the stress concentrating members, and
- a power transmission portion configured to transmit power for moving a stress concentrating member via a movable portion.

The unfolding method includes:

placing the empty box by causing the stress concentrating member located in the placement space to contact an inside of the empty box from an open side of the empty box; and transmitting the power for moving the stress concentrating member to the stress concentrating member.

In the transmitting the power for moving the stress concentrating member to the stress concentrating member, the power for moving the stress concentrating member is transmitted to the stress concentrating member so as to bring the stress concentrating member into contact with a corner, and the power for moving the stress concentrating member is further transmitted to the stress concentrating member so as to cause the stress concentrating member to unfold the corner by tearing and opening the corner.

The stress concentrating member includes a reverse slope blade that protrudes outward as the blade gets closer to a top of the blade.

The present disclosure can provide an unfolding device and unfolding method that can unfold an empty box into a single cross-shaped flat sheet in a short time.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
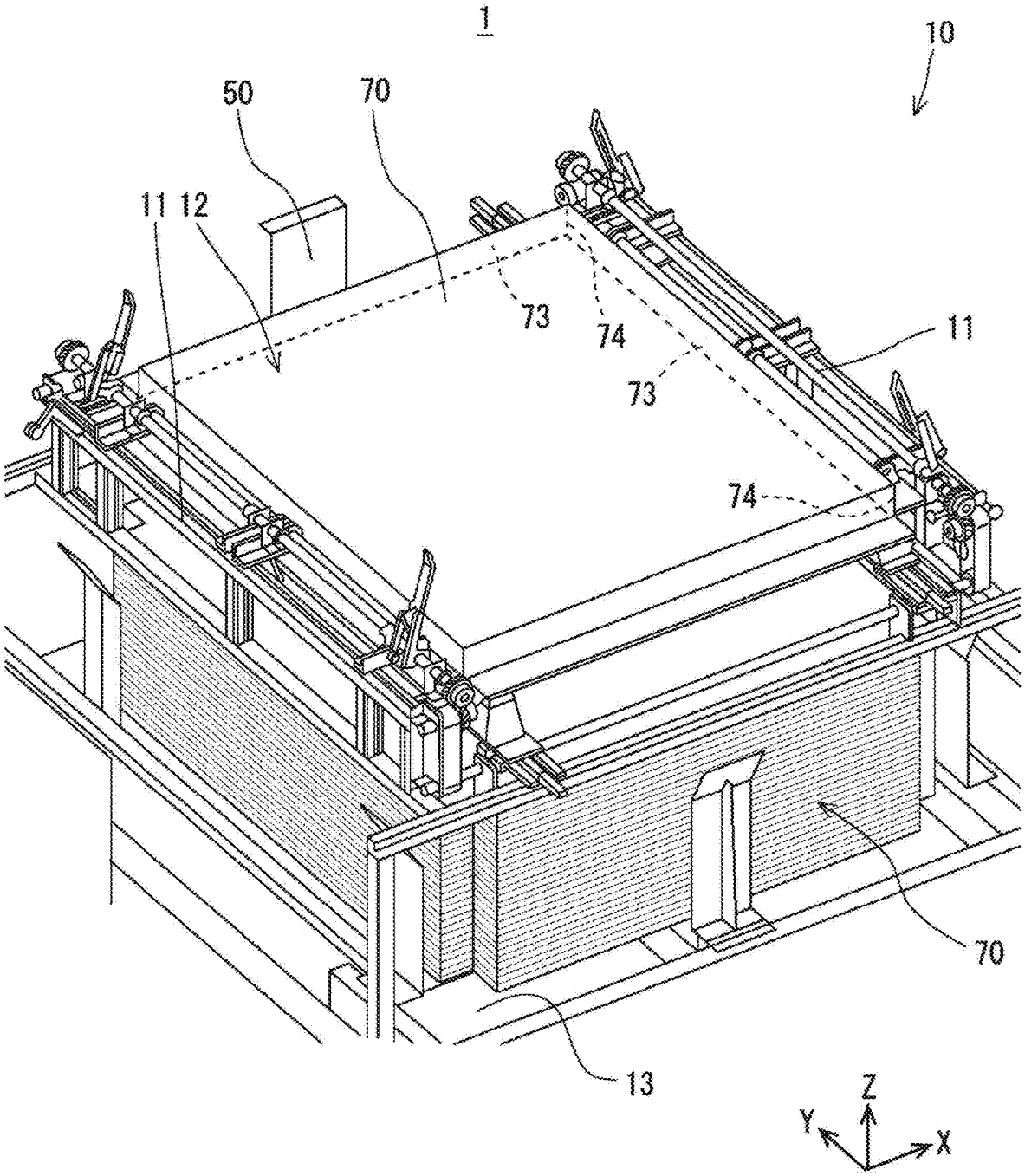
FIG. 1 is a perspective view illustrating a placement table in an unfolding device according to a first embodiment.

Hereinafter, a specific configuration of the present embodiment will be described with reference to the drawings. The following description shows preferred embodiments of the present disclosure, and the scope of the present disclosure is not limited to the following embodiments. Further, not all of the configurations described in the present embodiment are essential as means for solving the problem. For clarity of explanation, the following description and the drawings are omitted and simplified as appropriate. In the drawings, the same elements are denoted by the same reference numerals, and redundant descriptions are omitted as necessary.

First Embodiment

Figure 2:
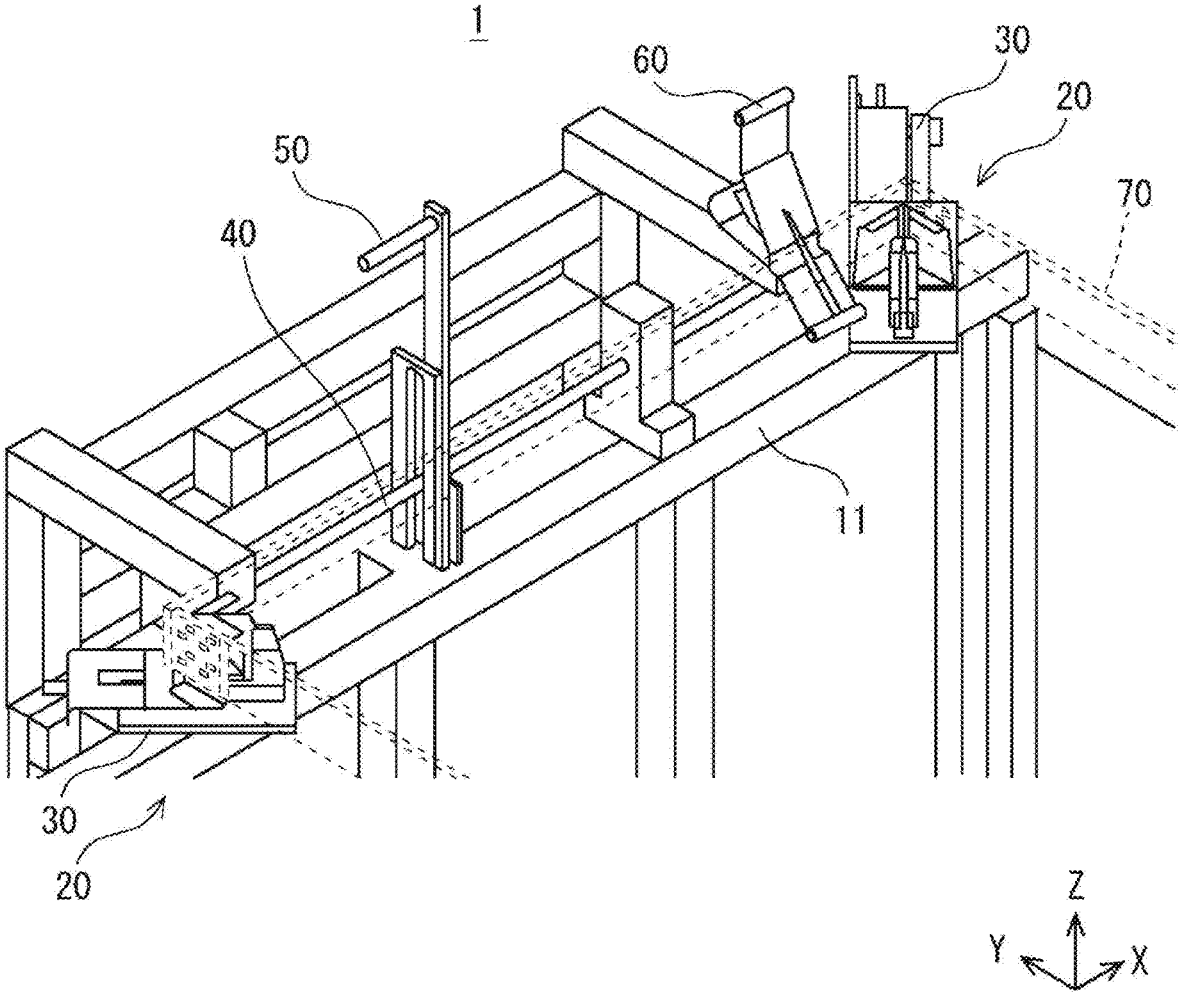
FIG. 2 is a perspective view illustrating the configuration of the unfolding device according to the first embodiment.
Figure 3:
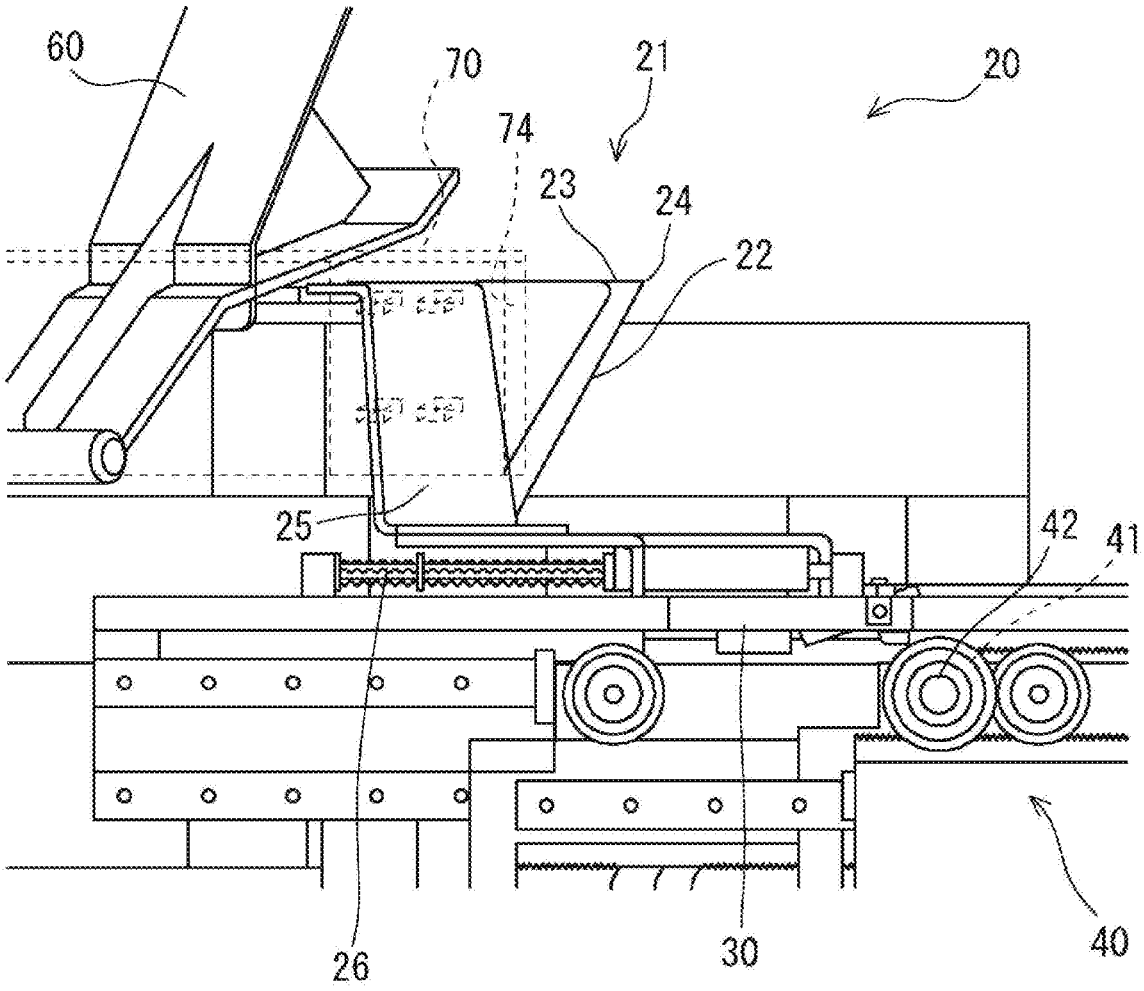
FIG. 3 is a schematic diagram illustrating the configuration of the unfolding device according to the first embodiment.
Figure 4:
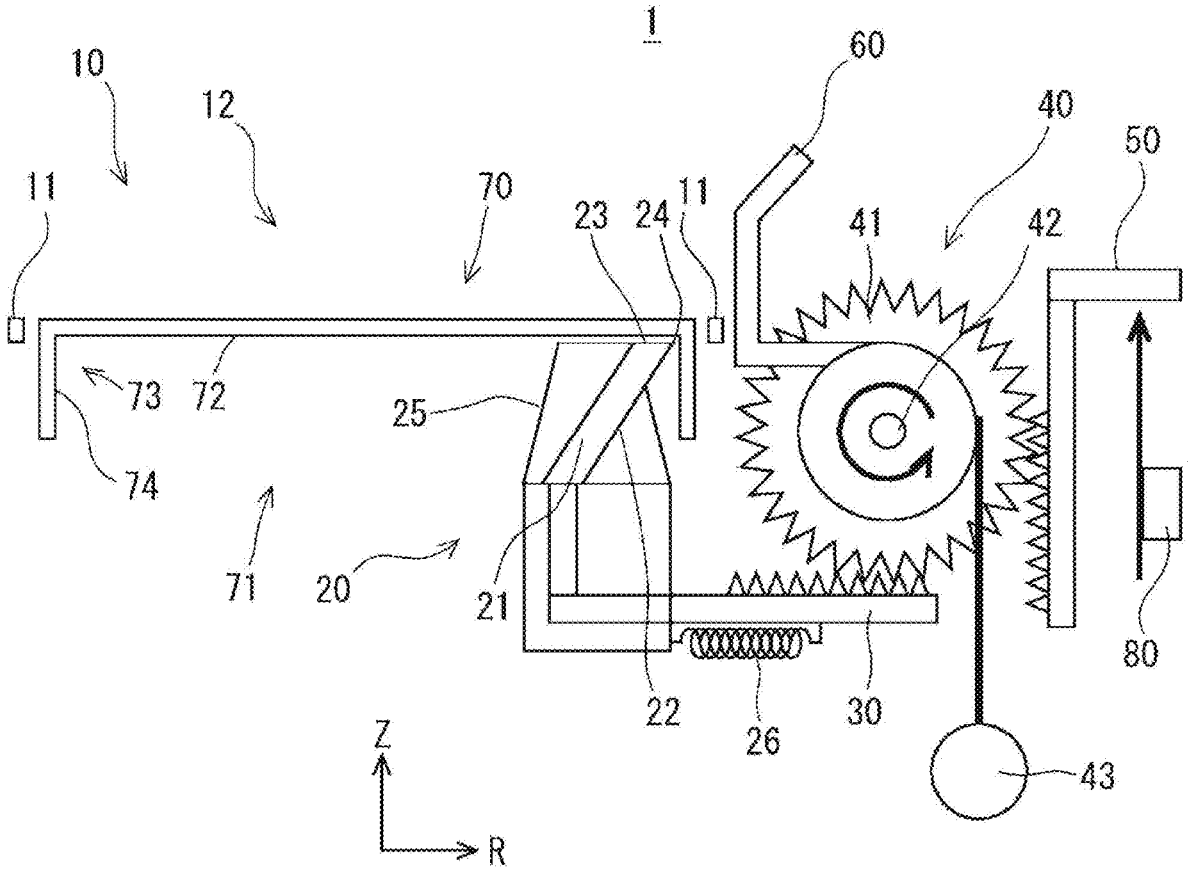
FIG. 4 is a schematic diagram illustrating the configuration of the unfolding device according to the first embodiment.

An unfolding device according to the first embodiment will be described. FIG. 1 is a perspective view illustrating a placement table 10 in an unfolding device 1 according to a first embodiment. FIG. 2 is a perspective view illustrating a configuration of the unfolding device 1 according to the first embodiment. FIG. 3 and FIG. 4 are schematic views illustrating a configuration of the unfolding device 1 according to the first embodiment. In FIG. 1 to FIG. 4, some reference numerals are omitted so as not to complicate the drawing. In FIG. 1, the stress concentrating member 20, the movable portion 30, the power transmission portion 40, and the side surface presser 60 are omitted. In FIGS. 2 to 4, only one side surface presser 60 is shown.

As illustrated in FIGS. 1 to 4, the unfolding device 1 includes a placement table 10, a plurality of stress concentrating members 20, a plurality of movable portions 30, a power transmission portion 40, an operation lever 50, and a plurality of side surface pressers 60. The unfolding device 1 unfolds the empty box 70 into a single cross-shaped flat sheet, and places the unfolded empty boxes 70 on top of each other. Here, for the convenience of explanation of the unfolding device 1, a XYZ Cartesian coordinate system is introduced. The Z-axis direction is defined as a vertical direction, and XY plane is defined as a horizontal plane.

Empty Box

The empty box 70 includes, for example, a lid in cardboard for transportation of a large lithium battery. Specifically, the empty box 70 includes a rectangular parallelepiped lid including waste cardboard boxes packed with batteries procured from overseas. Note that the empty box 70 may be an empty box such as a general corrugated fiberboard as long as it can be unfolded by the stress concentrating member 20. The empty box 70 has an opening 71 before unfolding. The inner surface of the empty box 70 facing the opening 71 is referred to as a bottom surface 72. The inner surface connected to the bottom surface 72 is referred to as a side surface 73. For example, the empty box 70 has one opening 71, one bottom surface 72, and four side surfaces 73. A portion of the inner side surface 73 of the empty box 70 including the intersecting line is referred to as a corner 74. Empty box 70 includes a plurality of corners 74. The empty box 70 includes, for example, four corners 74.

Placement Table

The placement table 10 has a frame 11 that matches the shape of the empty box 70 as viewed from above. For example, it has a frame 11 assembled in a cuboid or cuboid shape. A space 12 is formed between the rectangular frames 11 viewed from above the placement table 10. The stress concentrating member 20 and the movable portion 30 are arranged at the corner of the upper rectangular frame 11.

The open empty box 70 before unfolding is placed in the space 12. When the empty box 70 is placed in the space 12, the stress concentrating member 20 is positioned in the space 12 to place the empty box 70. When the empty box 70 is placed in the space 12, the empty box 70 is placed from the opening 71 side. Specifically, the empty box 70 is placed such that the opening 71 is directed in −Z axial direction and the outer bottom surface of the empty box 70 is directed in the +Z axial direction. Therefore, the stress concentrating member 20 located in the space 12 is brought into contact with the inside of the empty box 70 from the opening 71 side of the empty box 70, thereby placing the empty box 70. In this way, the frame 11 of the placement table 10 provides a space 12 for mounting the open empty box 70 before unfolding.

The frame 11 will be sometimes referred to as "placement frame," and the space 12 will be sometimes referred to as "placement space." The empty box 70 with the unfolded corners 74 falls through the space 12. Between the frames 11 in the lower portion of the placement table 10, the cradle 13 of the empty box 70 after unfolding is arranged.

Stress Concentrating Member

The plurality of stress concentrating members 20 are respectively arranged at four corners of the upper frame 11 arranged around the space 12. The stress concentrating member 20 can move in the direction in which the bisector of the corner of the upper frame 11 extends. As illustrated in FIG. 4, the direction in which the bisector in which the stress concentrating member 20 moves extends is referred to as a movement direction R. A direction toward the inside of the frame 11 in the movement direction R is referred to as an inner direction. On the other hand, a direction toward the outside of the frame 11 in the movement direction R is referred to as an outer direction. The outer direction may also be referred to as the +R-axis direction, and the inner direction may also be referred to as −R axial direction. In FIG. 4, the stress concentrating member 20 at one corner is shown, but the stress concentrating members 20 at the other corners also have respective movement directions R.

The stress concentrating member 20 guides unfolding of the empty box 70. Specifically, for example, the stress concentrating member 20 forms a notch in the corner 74 of the empty box 70. The plurality of stress concentrating members 20 respectively unfold the plurality of corners 74 where the side surfaces 73 on the inner side of the empty box 70 meet. The stress concentrating member 20 may include a blade portion 21 having a portion extending in a plane including a movement direction R and a Z-axis direction in which the corner 74 extends. For example, the blade portion 21 includes a blade (also referred to as a cutting edge) 22, a ridge 23, and a tip 24.

The ridge 23 extends in the movement direction R. The ridge 23 may have a part that is parallel to XY plane perpendicular to the Z-axis direction. As a result, the ridge 23 can be a seating surface on which the bottom surface 72 of the empty box 70 is placed. An end portion of the ridge 23 in the outward direction is a tip 24. The tip 24 is connected to the ridge 23 and the blade 22.

The blade 22 has a downward component. The blade 22 is tilted with a reverse slope. Specifically, the blade 22 may be tilted inwardly from the tip 24. The blade 22 has a reverse slope protruding outward as it gets closer to its top. When the empty box 70 is placed on the stress concentrating member 20 in the space 12, the blade 22 protrudes toward the corner 74 side toward the bottom surface 72 side of the empty box 70. The blade 22 may have a shorter distance from the corner 74 toward the bottom surface 72 of the empty box 70. This reduces the possibility of the empty box 70 floating during cutting by the stress concentrating members 20, and reduces the possibility of the stress concentrating members 20 being unable to cut the corners 74.

If the blade 22 has a taper protruding downward in the outward direction, the empty box 70 may float upward when the stress concentrating member 20 moves outward to perform unfolding. Even if the stiffness of the empty box 70 is high, it will be deformed at the load of unfolding, and as a result, the empty box 70 may escape upward during processing. In the present embodiment, since the reverse slope blade 22 is provided, it is possible to insert the tip 24 into the corner 74, it is possible to hold the empty box 70 at a processing load.

The stress concentrating member 20 is slidably moved along the movement direction R by the movable portion 30. When the empty box 70 before unfolding is placed in the space 12, the stress concentrating member 20 is located in the space 12. As a result, the stress concentrating member 20 places the empty box 70 before unfolding. The empty box 70 may be supported at four points by the stress concentrating member 20. The empty box 70 can be referred to as a floating state with respect to the frame 11 of the placement table 10.

As another method of unfolding the empty box 70, it is conceivable to fix the vicinity of the center of the empty box 70 by pressing it from above and below. However, in such a method of pressing and fixing from above and below, the upper pressing interferes structurally when the empty box 70 is set. The lower presser prevents the empty box 70 from being dropped as it is after unfolding. On the other hand, in the present embodiment, since the empty box 70 is brought into the floating state, the empty box 70 can be dropped directly onto the cradle 13 after unfolding without interfering with the setting.

The stress concentrating member 20 moves in a direction of pushing and opening the empty box 70 from inside toward outside of the empty box 70. Thus, the plurality of stress concentrating members 20 can simultaneously unfolds the plurality of corners 74 while centering the floating empty box 70. In general, since the empty box 70 is lightweight and has high strength and high rigidity, the resistance that the stress concentrating member 20 slides to the corner 74 while keeping the empty box 70 in the floating state is smaller than the resistance that the stress concentrating member 20 unfolds the corner 74. Therefore, after all the stress concentrating members 20 move in the outer direction with good balance and the movement of all the stress concentrating members 20 to the corners 74 is aligned, unfolding of the corners 74 starts. In this way, the plurality of stress concentrating members 20 can simultaneously unfold the plurality of corners 74 while centering the empty box 70 floating with respect to the frame 11 with respect to the space 12.

After all of the stress concentrating members 20 have reached the corners 74, the respective stress concentrating members 20 move outward. Thus, the stress concentrating member 20 unfolds (cuts) the corner 74 of the empty box 70. In this manner, the plurality of stress concentrating members 20 unfolds the corners 74 of the empty box 70 from the inside to the outside.

Movable Portions

The plurality of movable portions 30 are respectively attached to the plurality of stress concentrating members 20. The movable portions 30 are respectively arranged at four corners of the upper frame 11 which are arranged around the space 12 together with the stress concentrating member 20. The movable portion 30 transmits the power transmitted through the power transmission portion 40 to the stress concentrating member 20.

Power Transmission Portion

The power transmission portion 40 transmits power for moving the stress concentrating member 20 to the stress concentrating member 20 via the movable portion 30. Specifically, the power transmission portion 40 transmits power for moving the stress concentrating member 20 so as to bring the stress concentrating member 20 into contact with the corner 74. The power transmission portion 40 also transmits the power for moving the stress concentrating member 20 so as to cause the stress concentrating member 20 to unfold the corner 74 by tearing and opening the corner 74. The power transmission portion 40 transmits power for moving the stress concentrating member 20 to the stress concentrating member 20 such that the plurality of stress concentrating members 20 each tear and spread the plurality of corners 74 from the inside to the outside of the empty box 70.

The power transmission portion 40 includes, for example, a gear 41, a shaft 42, and a weight 43. The power transmission portion 40 may further include other members. The gear 41 is attached to the shaft 42. The gear 41 transmits the power input by the operation lever 50 to the shaft 42 and the movable portion 30. The gear 41 rotates in one direction to transmit power for the stress concentrating member 20 to unfold the corner 74 to the stress concentrating member 20 via the movable portion 30. As described above, the power transmission portion 40 can realize a series of operation processes in a single operation by connecting the unfolding of the empty box 70 with the power transmission structure of the same system.

The shaft 42 has, for example, a rod shape extending along the frame 11, and a plurality of gears 41 may be attached thereto. The shaft 42 transmits power input to a predetermined gear 41 to another gear 41.

The weight 43 is attached to the gear 41 via a gear 41 or a shaft 42. The weight 43 is raised by, for example, rotation of the gear 41 in one direction when power is input by the operation lever 50 of the robot 80. When no power is input to the operation lever 50 after the empty box 70 is unfolded, the weight 43 is lowered to rotate the gear 41 in the opposite direction in one direction. Accordingly, the weight 43 returns the stress concentrating member 20 to the position of the space 12.

Specifically, for example, when the robot 80 releases the operation lever 50, the weight 43 raised by the power transmitted by the operation lever 50 is lowered. Due to the lowering of the weight 43, the stress concentrating member 20 moves in the inward direction and is disposed in the space 12. Accordingly, the stress concentrating member 20 is disposed at a position where the next empty box 70 is placed. The side surface presser 60 is disposed at a position that serves as an input guide for the next empty box 70. In this way, by lowering the weight 43, each member of the unfolding device 1 can be returned to the original position.

Operation Lever

The operation lever 50 is an operation portion for inputting power for unfolding the empty box 70 into a single cross-shaped flat sheet. For example, after placing the empty box 70 in the space 12, the robot 80 operates the operation lever 50 to input power. As a result, the unfolding device 1 starts unfolding the empty box 70 into a single cross-shaped flat sheet.

In a general device design, a device that moves independently for each function can reduce troubles, but requires a long processing time. The unfolding device 1 of the present embodiment has the power transmission portion 40, so that the operation of unfolding the corner 74 of the empty box 70 can be made one action. That is, the unfolding device 1 operates the unfolding device 1 by the operation of the operation lever 50 by the robot 80, thereby unfolding the empty box 70 and dropping the unfolded empty box 70. Therefore, the unfolding device 1 utilizes the operation of the operation lever 50 and the weight of the weight 43, and eliminates the need for a power source. As a result, it is possible to perform unfolding in a short time, and it is possible to reduce troubles.

Side Surface Presser

The side surface presser 60 may be attached to the frame 11. The side surface presser 60 has a shape that opens upward in the outward direction when the empty box 70 before unfolding is placed in the space 12. The side surface presser 60 may contact the outer side of the empty box 70 when the empty box 70 before unfolding is placed in the space 12. As a result, it is possible to function as a guide for the empty box 70 set in the space 12.

The side surface presser 60 may be provided with anti-slip processing of the empty box 70 on a surface that contacts the empty box 70. Anti-slip processing includes, for example, spiking and knurling. The side surface presser 60 is preferably disposed near a destination where the stress concentrating member 20 moves while unfolding the corner 74 of the empty box 70.

In a case where there is no side surface presser 60 and the resistance of unfolding of the plurality of corners 74 of the empty box 70 is extremely varied, the unfolding of the plurality of corners 74 is not completed at the same time. Therefore, there is a case where unfolding of another corner 74 ends before unfolding of the corner 74 having a high resistance of unfolding ends. As a result, the pressing load of the stress concentrating member 20 to the corner 74 whose unfolding has not ended is lowered, and the corner 74 whose unfolding has not ended yet may remain non-unfolded. In this case, the stress concentrating member 20 cannot unfold the unfinished corner 74 and drags the empty box 70.

In the present embodiment, since the side surface presser 60 is provided, even when the unfolding resistance of the plurality of corners 74 is extremely varied, the stress concentrating member 20 at the corner 74 whose unfolding has ended can be moved in the outward direction by protruding the corner 74 whose unfolding has ended. The stress concentrating member 20 for the corner 74 whose unfolding does not end restricts the movement area of the empty box 70 by pressing the corner 74 against the side surface presser 60. Therefore, since the stress concentrating member 20 continues unfolding of the corner 74, the unfolding can be ended.

As described above, since the unfolding device 1 has the side surface presser 60, it is possible to suppress the remaining unprocessed due to the loss of load at all of the corners 74 while absorbing the variation in the processing resistance of the empty box 70. In this case, it is desirable that the contact surface of the side surface presser 60 also functions as a non-slip so as not to escape the empty box 70. In addition, as the side surface presser 60 is closer to the stress concentrating member 20, the above-described effect can be enhanced.

The side surface presser 60 may be movable with the frame 11 as a rotation axis. For example, the side surface presser 60 may be rotatably movable so as to cause the unfolded empty box 70 to fall on the cradle 13 of the empty box 70 disposed below.

The unfolded empty box 70 may have variations in the falling posture and trajectory due to accidental catching or the like. The unfolded empty box 70 has significantly reduced three-dimensional rigidity. Therefore, when the empty box 70 is inserted, the side surface presser 60 having a function as a guide is connected to the gear 41 and is rotated synchronously with the unfolding. Thus, by pushing the unfolded empty box 70 from above, the empty box 70 is dropped to the cradle 13. As described above, the unfolding device 1 of the present embodiment can cause the side surface presser 60 not only to function as a guide when the empty box 70 is inserted, but also to function as a presser of the empty box 70 during unfolding and as an assist to the cradle 13 of the unfolded empty box 70.

Safety Cover

The stress concentrating member 20 may further include a safety cover 25 in addition to the blade portion 21 having the blade 22. The safety cover 25 houses the blade 22. The top part of the safety cover 25 extends in the movement direction R. The top part of the safety cover 25 may include a portion parallel to XY plane perpendicular to the Z-axis direction. Thus, the top part of the safety cover 25 can serve as a seating surface on which the bottom surface 72 of the empty box 70 is placed. That is, the safety cover 25 allows the empty box 70 to be placed on the top part. The safety cover 25 moves the empty box 70 floating with respect to the frame 11 while being centered with respect to the space 12.

In the stress concentrating member 20, the safety cover 25 is attached to the movable portion 30 via a spring 26. Of the stress concentrating members 20, the blade portion 21 having the blade 22 is directly attached to the movable portion 30. Therefore, the power transmission portion 40 transmits the power for moving the safety cover 25 to the safety cover 25 via the spring 26 and the movable portion 30. The power transmission portion 40 transmits power for moving the blade 22 to the blade 22 via the movable portion 30.

The power transmission portion 40 transmits the power for moving the safety cover 25 storing the blade 22 to the safety cover 25 so as to bring the safety cover 25 into contact with the corner 74, and the power transmission portion 40 further transmits the power for moving the blade 22 to the blade 22 so as to expose the blade 22 from the safety cover 25 that is in contact with the corner 74 and to cause the blade 22 to unfold the corner 74 by tearing and opening the corner 74.

Comparative Example

Figure 5:
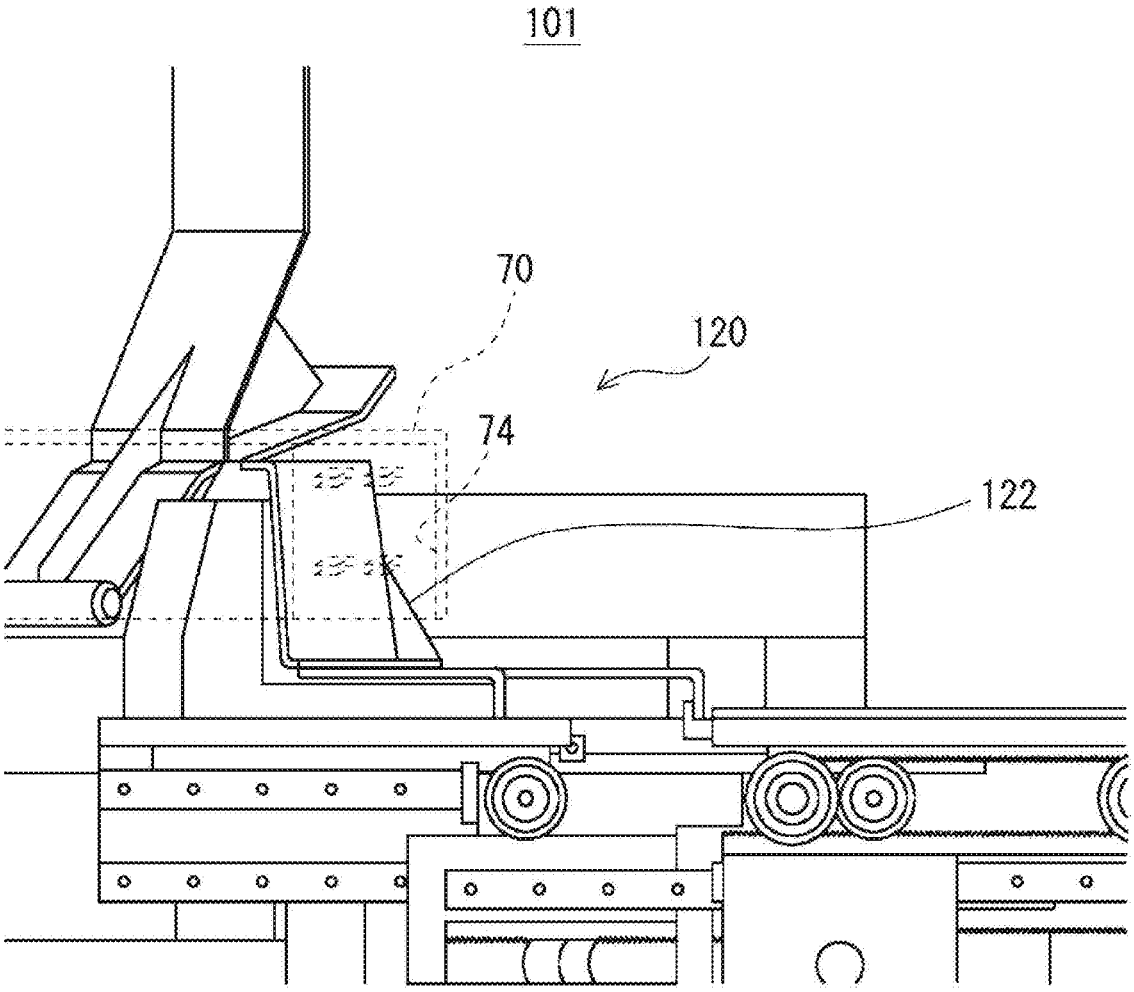
FIG. 5 is a schematic view illustrating a stress concentrating member in the unfolding device according to a comparative example.

In order to explain the effect of the reverse slope blade 22 and the safety cover 25 having a reverse slope, the present embodiment is compared with a comparative example. FIG. 5 is a schematic diagram illustrating the stress concentrating member 120 in the unfolding device 101 according to the comparative example. As shown in FIG. 5, the blade 122 of the stress concentrating member 120 of the comparative example protrudes outward downward. When the blade 122 is brought into contact with the blade 122 so as to make a cut from the lower end of the corner 74, the empty box 70 floats upward during processing. Therefore, there is a need for a restraining member that suppresses lifting during processing.

Further, the stress concentrating member 120 of the comparative example does not include the safety cover 25. Therefore, when placing the empty box 70 in the space 12, if the blade 22 is out, the blade 122 is caught in a portion different from the corner 74 in the centering step of the empty box 70, it is not possible to smoothly move the stress concentrating member 20. Furthermore, in the case of maintenance or the like, it is dangerous in the first place if the blade 22 is always ejected.

On the other hand, since the blade 22 of the present embodiment has a reverse slope, it is possible to suppress the floating of the empty box 70 during processing. Further, in the stress concentrating member 20 of the present embodiment, the blade 22 is stored in the safety cover 25 which also serves as the seating surface of the empty box 70. Then, the safety cover 25 moves via the spring 26 by the power transmission operation. As a result, the stress concentrating member 20 can move to the corner 74 while centering the empty box 70. Then, in a state in which the safety cover 25 is in contact with the corner 74, when the power transmission portion 40 transmits the power, the blade 22 is exposed from the safety cover 25, and unfolding is started. After the processing is completed, the stress concentrating member 20 including the blade 22 and the safety cover 25 passes through the unfolded corner 74. As a result, the empty box 70 that has lost the seating surface falls onto the cradle 13. In addition, the safety cover 25 that has passed through the unfolded corner 74 is moved by the spring 26 so as to retract the blade 22.

Unfolding Method

Figure 6:
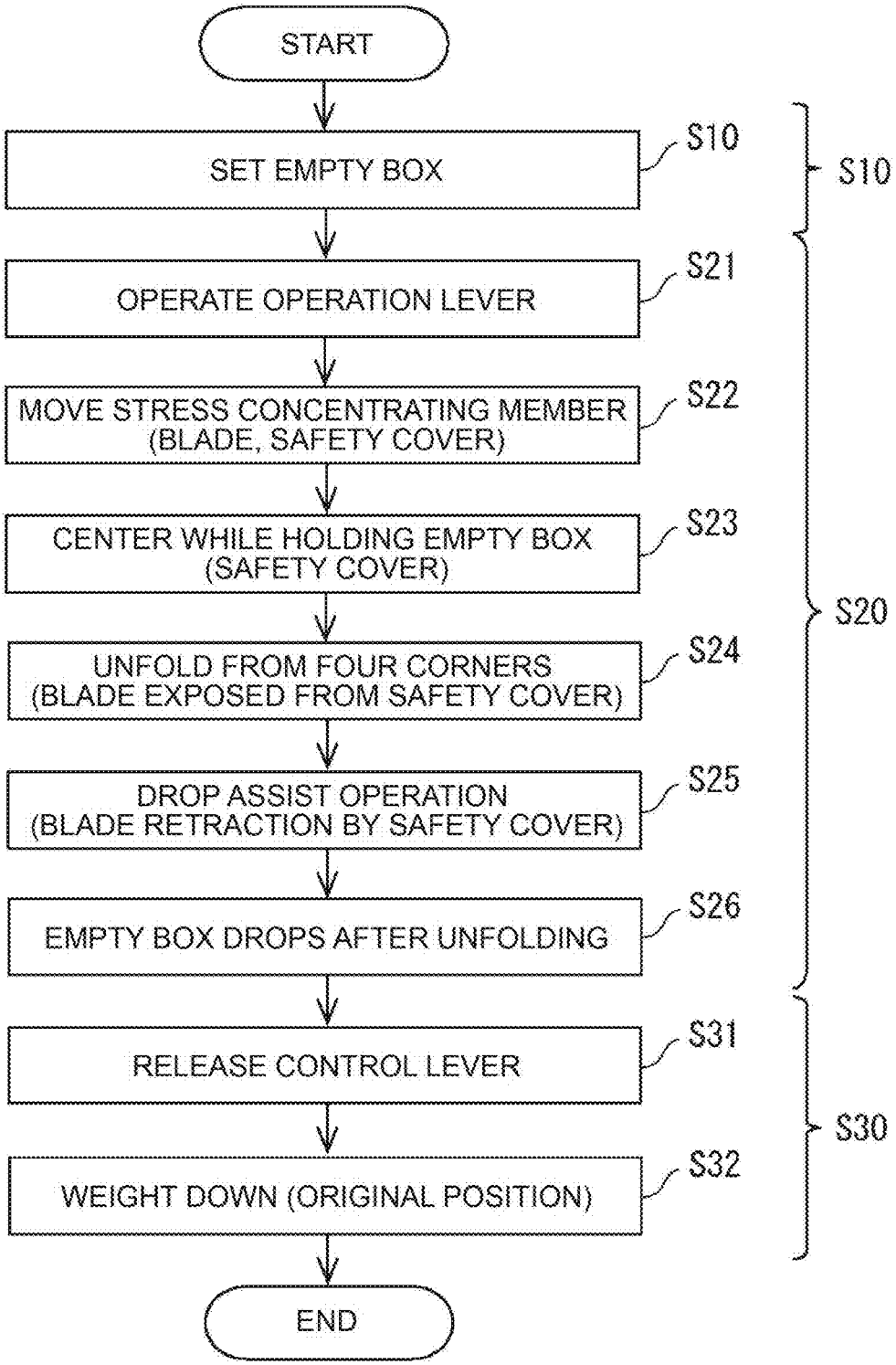
FIG. 6 is a flowchart illustrating an unfolding method using the unfolding device according to the first embodiment.

Next, an unfolding method using the unfolding device 1 will be described. FIG. 6 is a flowchart illustrating an unfolding method using the unfolding device 1 according to the first embodiment. As shown in S10 of FIG. 6, the robots 80 set the empty boxes 70. Specifically, the robot 80 places the empty box 70 by setting the empty box 70 and bringing the stress concentrating member 20 located in the space 12 into contact with the inside of the empty box 70 from the opening 71 side of the empty box 70.

Next, as shown in S20, the robots 80 operate the operation levers 50 to transmit the power for moving the stress concentrating member 20 to the stress concentrating member 20 through the power transmission portion 40. In S20, power is transmitted to the stress concentrating member 20 to move the stress concentrating member 20 (including the blade 22 and the safety cover 25) so that the stress concentrating member 20 contacts the corner 74. Further, the blade 22 is exposed from the safety cover 25, and power for moving the stress concentrating member 20 to unfold the corner 74 by the blade 22 tearing and spreading the corner 74 is transmitted to the stress concentrating member 20.

Specifically, S20 includes manipulation (S21) of the operation lever, movement (S22) of the stress concentrating member 20, centering (S23) while holding the empty box 70, unfolding (S24) of the four corners 74, drop assist operation (S25), and drop (S26) of the unfolded empty box. In S22, the stress concentrating member 20 includes a blade 22 and a safety cover 25. In S23, the safety cover 25 performs centering while holding the empty box 70. In S24, the blade 22 exposed from the safety cover 25 performs unfolding of the four corners 74. In S25, when the side surface presser 60 assists in falling, the safety cover 25 retracts the blade 22.

Next, as shown in S30, the robots 80 move the operation levers 50 apart to return the unfolding device 1 to the original position. For example, by releasing the operation lever 50, the weight 43 raised by the power transmitted by the operation lever 50 is lowered. Due to the lowering of the weight 43, the stress concentrating member 20 moves in the inward direction and is placed in a position to support the next empty box 70. The side surface presser 60 is disposed at a position that serves as an input guide for the next empty box 70.

Specifically, S30 includes S31 the operation lever 50 and S32 the weight 43 to the original position.

Next, the effects of this embodiment will be described. The unfolding device 1 of the present embodiment moves the stress concentrating member 20 by the power transmitted through the power transmission portion 40. As a result, the plurality of stress concentrating members 20 unfolds the corners 74 from inside of the empty box 70 in the outward direction (+R axis direction). Therefore, the empty box 70 can be unfolded into a single cross-shaped flat sheet in a short time.

Further, the unfolding device 1 of the present embodiment operates by the input of power from the operation lever 50. For example, by setting an empty box 70 such as a three-dimensional lid lifted by the robot 80 in the unpacking operation to the apparatus and performing a simple operation of only the operation lever 50, the unfolding device 1 can drop the empty box 70 in a cross-shaped unfolded shape. Therefore, the robot 80 can stably perform processing in a short time.

Although the embodiments of the present disclosure have been described above, the present disclosure includes appropriate modifications that do not impair the objects and advantages thereof, and further, the present disclosure is not limited by the above-described embodiments. Each of the configurations in the first and second embodiments may be combined as appropriate. Further, the following matters are also within the scope of the technical idea of the present embodiment.

What is claimed is:

1. An unfolding device configured to unfold an empty box into a single cross-shaped flat sheet, the unfolding device comprising:

a placement frame that provides a placement space for placing the empty box that is open before unfolding;

a plurality of stress concentrating members configured to unfold a plurality of corners where inner side surfaces of the empty box meet;

a plurality of movable portions attached to the stress concentrating members; and a power transmission portion configured to transmit power for moving a stress concentrating member via a movable portion, wherein:

the stress concentrating member is configured to be located in the placement space and contact an inside of the empty box from an open side of the empty box when the empty box is placed;

the power transmission portion is configured to transmit the power for moving the stress concentrating member so as to bring the stress concentrating member into contact with a corner, and the power transmission portion is configured to further transmit the power for moving the stress concentrating member so as to cause the stress concentrating member to unfold the corner by tearing and opening the corner; and the stress concentrating member includes a reverse slope blade that protrudes outward as the blade gets closer to a top of the blade.

2. The unfolding device according to claim 1, wherein:

the stress concentrating member includes a safety cover that stores the blade; and the safety cover is configured to allow the empty box to be placed on a top part of the safety cover, and move the empty box floating with respect to the placement frame while centering the empty box in the placement space.

3. The unfolding device according to claim 2, wherein:

the safety cover is attached to the movable portion via a spring;

the blade is attached to the movable portion; and the power transmission portion is configured to transmit the power for moving the safety cover to the safety cover via the spring and the movable portion, and transmit the power for moving the blade to the blade via the movable portion.

4. The unfolding device according to claim 3, wherein the power transmission portion is configured to transmit the power for moving the safety cover storing the blade to the safety cover so as to bring the safety cover into contact with the corner, and the power transmission portion is configured to further transmit the power for moving the blade to the blade so as to expose the blade from the safety cover that is in contact with the corner and to cause the blade to unfold the corner by tearing and opening the corner.

5. An unfolding method for unfolding an empty box into a single cross-shaped flat sheet using an unfolding device, the unfolding device including a placement frame that provides a placement space for placing the empty box that is open before unfolding, a plurality of stress concentrating members configured to unfold a plurality of corners where inner side surfaces of the empty box meet, a plurality of movable portions attached to the stress concentrating members, and a power transmission portion configured to transmit power for moving a stress concentrating member via a movable portion, the unfolding method comprising:

placing the empty box by causing the stress concentrating member located in the placement space to contact an inside of the empty box from an open side of the empty box; and transmitting the power for moving the stress concentrating member, wherein in the transmitting the power for moving the stress concentrating member, the power for moving the stress concentrating member is transmitted to the stress concentrating member so as to bring the stress concentrating member into contact with a corner, and the power for moving the stress concentrating member is further transmitted to the stress concentrating member so as to cause the stress concentrating member to unfold the corner by tearing and opening the corner, and the stress concentrating member includes a reverse slope blade that protrudes outward as the blade gets closer to a top of the blade.

* * * * *